United States Patent [19]

Rothman

[11] 4,449,291

[45] May 22, 1984

[54] METHOD OF MAKING A MULTIPLE LAYER COIL WINDING SYSTEM

[75] Inventor: Irwin L. Rothman, Goshen, N.Y.

[73] Assignee: Loral Corporation, Yonkers, N.Y.

[21] Appl. No.: 318,399

[22] Filed: Nov. 4, 1981

[51] Int. Cl.[3] ..... H01F 7/06

[52] U.S. Cl. ..... 29/605; 140/92.1; 156/169; 242/7.11; 242/7.14

[58] Field of Search ..... 29/605; 242/7.03, 7.11, 242/7.14, 86.1, 107.1; 156/169, 175; 140/92.1; 72/147; 336/205, 232

[56] References Cited

U.S. PATENT DOCUMENTS 1,813,994 7/1931 George ..... 140/92.2

4,165,053 8/1979 Konig ..... 242/107.1

*Primary Examiner*—Mark Rosenbaum
*Assistant Examiner*—P. W. Echols
*Attorney, Agent, or Firm*—Charles E. Temko

[57] ABSTRACT

The disclosure relates to a technique for winding multiple layer flat electrical coils. Each coil is wound from the inside outward and neither end of the coil comes in contact with the interior of the winding. The system is capable of producing an epoxy-impregnated flat coil of variable circumference, shape, thickness, number of turns, and wire gauge. Coils are wound in pairs using a unitary length of wire, one coil being wound at the same speed of the other, and in the same direction.

3 Claims, 9 Drawing Figures

METHOD OF MAKING A MULTIPLE LAYER COIL WINDING SYSTEM

BACKGROUND OF THE INVENTION

This invention relates generally to the field of coil winding of electrical conductors for electronic and similar applications, and more particularly to an improved technique for winding flat or pancake types often used in multiples in electronic devices to provide inductive functions.

Such coils are, of course, well known in the art. However, prior art types of coils wound in the traditional manner have an inner end and an outer end of the single length of wire used to form the coil. There is thus the problem of bringing outwardly the inner end of the coil in order to join it to another conductor for electrical communication. When the coil is to be encapsulated or otherwise encased, provision must be made in the area of the center of the coil for such communication. If a series of coils are to be interconnected and stacked, each coil of the stack unit has an inner end brought to the periphery for such interconnection, or a joint must be made on the inside of the individual coil.

SUMMARY OF THE INVENTION

Briefly stated, the invention contemplates the provision of an improved system for winding individual coils such that both ends of the coil can be located on the outer periphery thereof at the completion of the winding operation. As a result, a flat coil may be produced to exact dimensions. Coils may be stacked to obtain the desired total number of turns by merely interconnecting the external ends of the coil to those of adjacent coils. Total stack resistance can be varied by using coils of differing wire gauge.

Other advantages of this construction lie in the ability to provide tap points on the exterior of a plurality of coils, where required, and the ability to insert a large coil stack, member by member through a small opening during the manufacture of an electrical device. Exact dimensioning of thickness is possible without the necessity of a paper or Mylar dielectric insulator being used between windings, and no permanent bobbin is necessary for constructing the coil.

The manufacture of coils in accordance with the invention requires the provision of the usual pair of compression plates and a removable slotted divider which provides an anchor point for holding an inwardly disposed midpoint of a length of wire which forms the equivalent of a pair of inner ends already interconnected. Two coils are formed simultaneously, one on each side of the divider, the divider being removed after the winding operation. The center of the coil may be round, oblong, square, triangular, or rectangular in configuration, as desired. Likewise, the wire employed may be of any gauge and in any equivalent circular mil pattern, (round, square, oval or rectangular) of the particular gauge of wire required.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENTS

Figure 1:
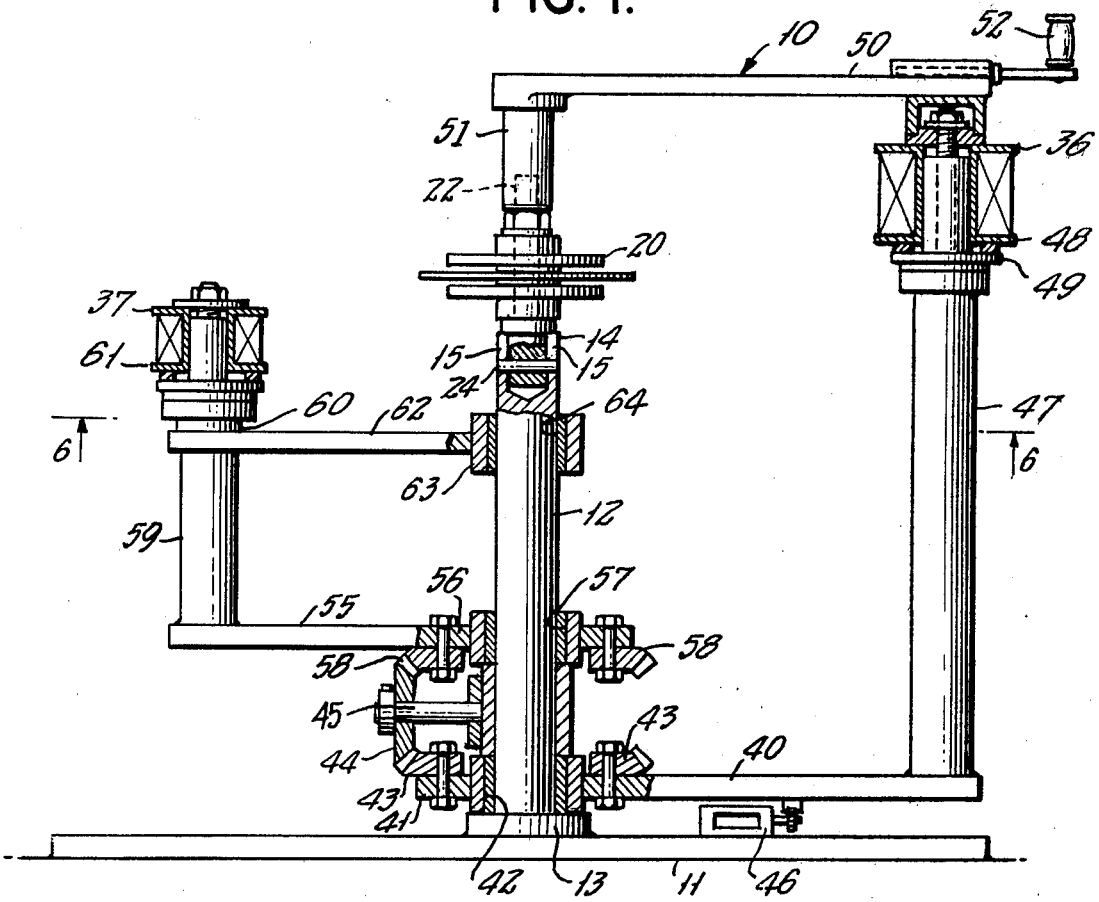
FIG. 1 is a schematic side elevational view showing a first embodiment of the invention.
Figure 3:
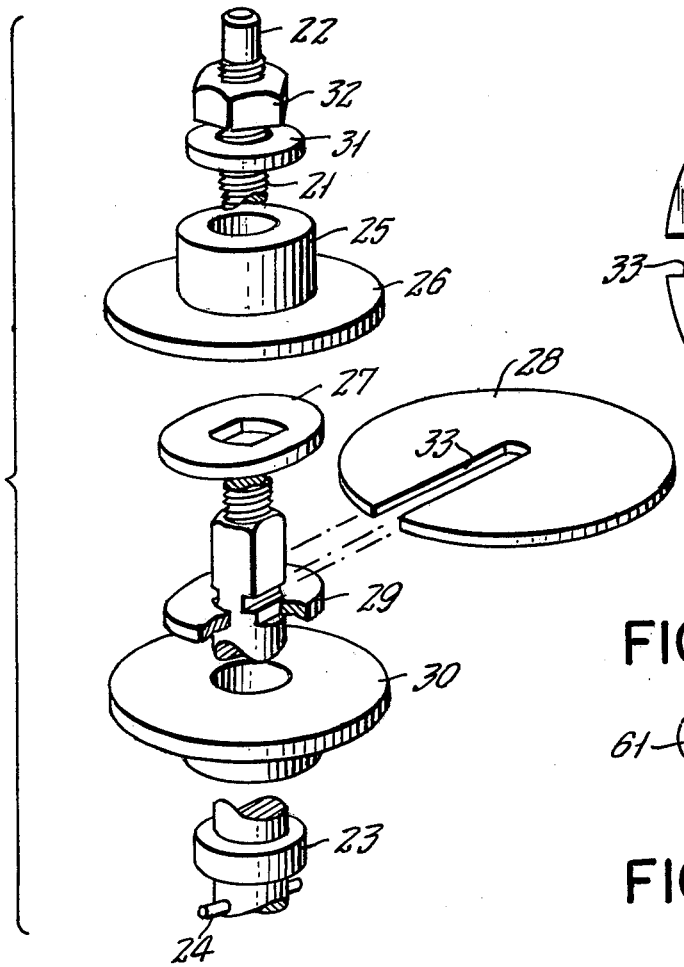
FIG. 3 is an exploded view in perspective showing a typical coil winding element employed in the structures of FIGS. 1 and 2.
Figure 4:
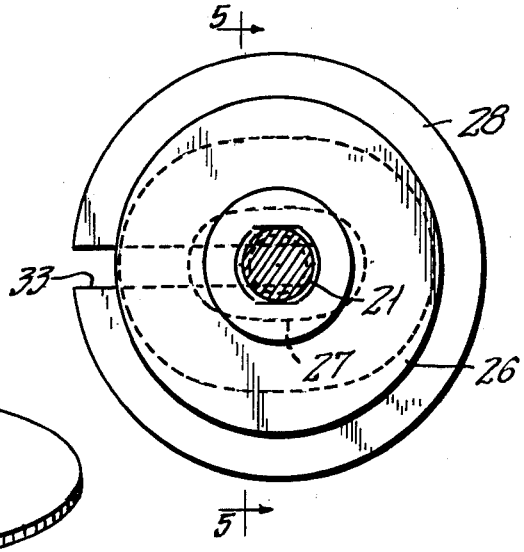
FIG. 4 is a side elevational view of the coil winding element in assembled condition.
Figure 6:
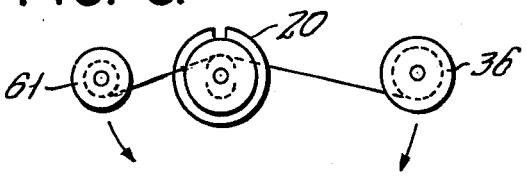
FIG. 6 is a schematic cross sectional view as seen from the plane 6—6 in FIG. 1.
Figure 7:
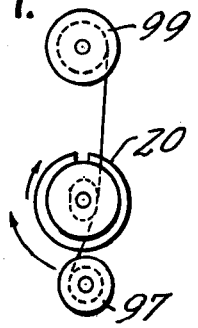
FIG. 7 is a schematic cross sectional view as seen from the plane 7—7 in FIG. 2.

Referring to FIG. 1 in the drawing, the first embodiment of the invention, generally indicated by reference character 10, includes a supporting base 11 which may rest upon a horizontal surface, or be clamped to a vertical surface (not shown). Extending upwardly from the base 11 is a fixed shaft 12, including a lower secured end 13 and an upper free end 14. The shaft 12 is hollow, and includes one or more longitudinally extending slots 15 selectively engageable with a coil winding element 20 (FIG. 3).

The coil winding element 20 includes a shaft 21 having a first end 22 and a second end 23 including a pin 24 engageable in a slot 15 to fix the same against rotation during a coil winding operation. The first end 22 is provided with an enlargement at 25 bearing upon a first compression plate 26, a first coil spacer 27, a slotted removable divider 28, a second coil spacer 29 and a second compression plate 30. An annular washer 31 and nut 32 permit the abovedescribed elements to be tightened against each other for a coil winding operation, and to be further tightened after removal of the divider 28, as will more fully appear. This removal is possible by the provision of a radially extending slot 33 in the divider 28 which also serves as an anchor point for the middle point of a wire segment used for winding an individual coil.

To provide for the simultaneous winding of each of a pair of coil segments at the same time, there is provided a main wire supply element 36 and an auxiliary supply element 37.

The main supply element 36 is in the form of a spinning flyer, and includes a first arm 40 having an end 41 forming an opening 42 with a bearing. Secured to a surface of the end 41 is a bevel gear 43 meshing with a bevel gear 44 on a shaft 45. The arm 40 interconnects with a centrally disposed member 47 mounting a rotating wire bobbin 48, the bobbin having a slipclutch means 49 for tensioning the wire during a winding operation. A second arm 50 includes a pivot member 51 engaging the end 22 of the element 20 to freely turn thereon. A manually engageable handle 52 is provided to impart motion to the device.

The auxiliary supply element 37 also forms a spinning flyer, and includes a first arm 55, and end 56 of which forms an opening 57 with a bearing. A bevel gear 58 is fixed thereon and also engages the bevel gear 44. A central member 59 has an extension 60 thereon supporting a freely turning bobbin 61 with slipclutch means, and a second arm 62 includes an end portion 63 with an opening 64 having a bearing surrounding the shaft 12.

At the commencement of a winding operation, a Veeder-Root type counter is set to zero and the free end of a spool of wire on the main supply element 36 is engaged with the auxiliary supply element 37, and a length of wire corresponding to one half the total amount of wire to be wound into a single coil is transferred. When the midpoint is reached, it is engaged within the slot 33 of the divider 28 as shown in FIG. 1, and the winding operation is then commenced in either direction. Whatever rotational direction is imparted to the main supply element 36, the corresponding rotation will be imparted in the opposite direction in the auxiliary supply element 37 resulting in both sections of the coil pair being effectively wound in the same direction, as viewed from an end of the shaft 21, through the desired number of turns. When this number has been reached, the supply emanating from the element 37 will be exhausted, and the segment emanating from the supply element 36 may then be cut to result in a finished coil with both ends on the outer periphery thereof.

At this point, an amount of epoxy adhesive may be injected into the slot 33 of the divider 28, which may then be removed spreading the epoxy in the process. The compression plates 26 and 30 are tightened using the nut 32, and the epoxy allowed to set to cure. While waiting for the curing process, the coil winding element 20 may be removed, to be replaced by a similar one for a subsequent coil winding operation.

Figure 2:
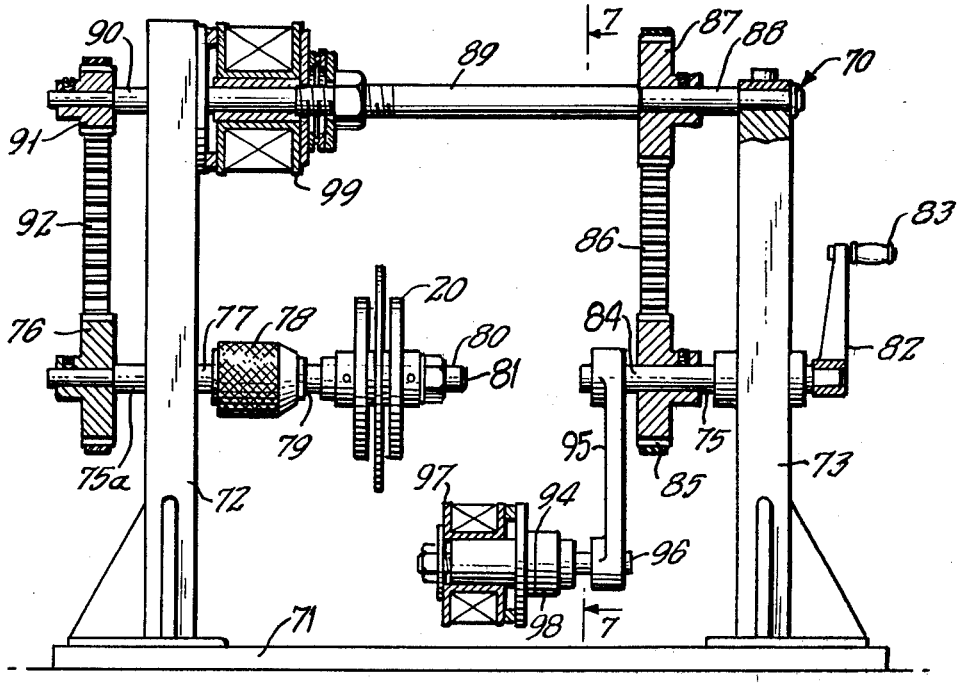
FIG. 2 is a schematic side elevational view showing a second embodiment of the invention.

Turning now to the second embodiment of the invention, illustrated in FIG. 2 of the drawing, there is illustrated a means for accomplishing the same purpose by providing only a single spinning flyer or spinner which orbits about the coil winding element at a speed twice that of the coil winding element, which is rotated during the winding operation to effect winding of one of the coil pairs.

The device, generally indicated by reference character 70, includes an elongated base 71 mounting first and second laterally extending supports 72 and 73, respectively. The support 73 engages a shaft 76 on bearings. A shaft **76*a* mounts a gear 76 on a segment which extends to a turn counter (not shown). An opposite end 77 mounts a chuck 78 which engages the shaft 79 of a coil winding element 80, similar to the element 20** in the first embodiment.

The opposite end 81 of the coil winding element 80 is free. A crank member 82 is supported on the shaft 75. The member 82 includes a handle 83 and a shaft 84 which mounts a gear 85 for relative movement. The gear 85 interconnects through a sprocket belt 86 to a gear 87 on one end 88 of a shaft 89, the opposite end 90 mounting a corresponding gear 91 engaging a sprocket belt 92 interconnecting with the gear 76. It will be observed that the gear 76 has twice the number of teeth as the gear 85.

The gear 85 is fixed relative to a spinner element 94 including a transverse element 95 and a longitudinal member 96 having an auxiliary wire supply bobbin 97 and slipclutch 98. A main wire supply element 99 is fixed in position for rotation.

The operation of the second embodiment is somewhat similar to that of the first embodiment, a segment of wire being drawn from the main supply element 99 and transferred to the bobbin 97. The midpoint of the coil is inserted in the slot of the removable divider of the coil winding element 80, and the winding operation is commenced by turning the crank member 82 in either direction. As the coil winding element 80 rotates, the spinner element 94 will rotate in the same direction at twice the speed of the element 80, so that both coil sections of the pair will be wound in the same direction at the same effective rate.

Figure 5:
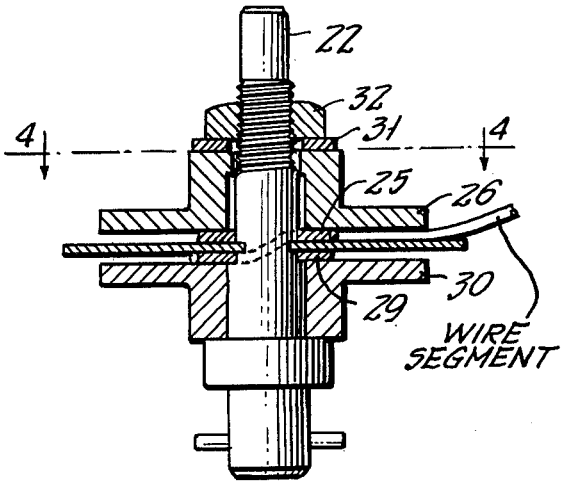
FIG. 5 is a cross sectional view of the coil winding element of FIG. 3 at the start of a winding operation.

FIG. 5 illustrates the arrangement of the midpoint of the wire segment used to form a single coil, with one end being directed toward the auxiliary supply, and the other toward the main supply. It will be observed that there is no loop at the midpoint, and when the coil is completed, the midpoint is detectable only by a shift in that segment of wire from one coil section to the other.

Figure 8:
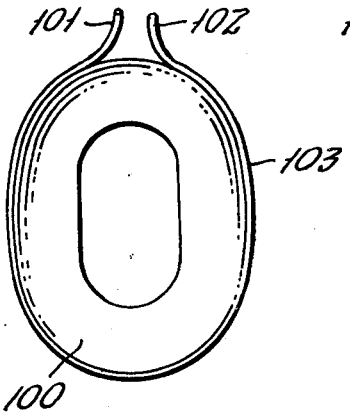
FIG. 8 is an end elevational view of a completed coil in accordance with the invention.
Figure 9:
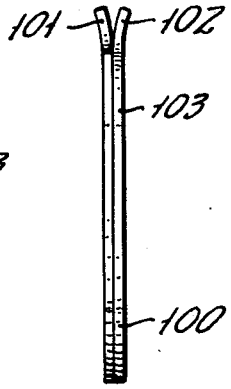
FIG. 9 is a side elevational view of a completed coil.

FIGS. 8 and 9 illustrate a completed coil 100 of oblong shape in which a single length of wire has been coiled in accordance with the invention. The particular shape is, of course, arbitrary, and depending upon that of the members 27 and 29, the coil can be square, round, or any other desired shape. In each case, the body of the coil has first and second ends 101 and 102 which are at the periphery 103 of the coil.

I wish it to be understood that I do not consider the invention limited to the precise details of structure shown and set forth in this specification, for obvious modifications will occur to those skilled in the art to which the invention pertains.

I claim:

1. A method for winding an electrical coil which comprises the steps of:

providing a shaft having a pair of spaced compression plates between which the coil is wound;

providing a slotted planar divider selectively positioned on said shaft between said compression plates;

providing a predetermined length of wire used for winding a coil, and determining its substantial midpoint;

engaging said wire upon said slotted divider so that a segment of wire will lie on each side of said divider; and winding said predetermined length upon said shaft commencing at said midpoint between said compression plates to form a pair of coil sections wound in the same direction, as viewed from an end of the shaft, and interconnected at the inner peripheries thereof at said midpoint.

2. In the method of claim 1, the additional step of rotating said shaft in a first direction to wind one of said pair of coil sections, and simultaneously winding the other of said coil sections in the same direction using a spinner means having a rotational speed twice that of said shaft.

3. In the method set forth in claim 1, the further steps of: flowing an adhesive through the slot in said divider to secure the convolutions of the coils in position, and removing the divider after winding to spread said adhesive into the space previously occupied by said divider.

* * * * *